US006938283B1

(12) United States Patent
Martinez

(10) Patent No.: US 6,938,283 B1
(45) Date of Patent: Sep. 6, 2005

(54) SINK AND FAUCET SUPPORT ASSEMBLY

(76) Inventor: Graciela Martinez, 520 N. Wille St., Mount Prospect, IL (US) 60056

( * ) Notice: Subject to any disclaimer, the term of this patent is extended or adjusted under 35 U.S.C. 154(b) by 0 days.

(21) Appl. No.: 11/065,658

(22) Filed: Feb. 25, 2005

(51) Int. Cl.[7] ..... A47B 77/06; A47K 1/04; E03C 1/00

(52) U.S. Cl. ..... 4/630; 4/619; 4/643

(58) Field of Search ..... 4/619, 630, 631, 4/643, 650, 660, 695, 696

(56) References Cited

U.S. PATENT DOCUMENTS

| | | | | |
|---|---|---|---|---|
| 1,409,255 A | | 3/1922 | Smith | |
| 2,146,969 A | * | 2/1939 | Marshall | 4/630 |
| 2,441,563 A | * | 5/1948 | Clark | 4/630 |
| 2,899,137 A | | 8/1959 | Martin | |
| 3,824,636 A | * | 7/1974 | Brown | 4/619 |
| 3,915,524 A | * | 10/1975 | Langston | 4/650 |
| 5,070,554 A | | 12/1991 | Bertoli | |
| 5,253,376 A | | 10/1993 | Fait | |
| D430,274 S | | 8/2000 | Marshall | |
| 6,219,859 B1 | * | 4/2001 | Derakhshan | 4/675 |
| D456,065 S | | 4/2002 | Jones et al. | |
| 6,643,867 B2 | | 11/2003 | Silverman et al. | |

* cited by examiner

*Primary Examiner*—Tuan Nguyen

(57) ABSTRACT

A sink and faucet support assembly includes a housing that has a bottom wall, a top wall and a peripheral wall attached to and extending between the top and bottom walls. The peripheral wall includes a front wall, a first side wall and a second side wall. A back side of the housing is open. The top wall has an opening extending therethrough. A sink apparatus includes a bowl portion and a base that has a shape adapted for being positioned in the opening. The bowl portion has a drain opening therein extending through the base. A ledge is attached to an upper edge of the bowl portion. A faucet apparatus is mounted on the ledge. A water supply is fluidly coupled to the ledge. A drainpipe extends into the housing through the back side and is fluidly coupled to the drain opening.

7 Claims, 3 Drawing Sheets

SINK AND FAUCET SUPPORT ASSEMBLY

BACKGROUND OF THE INVENTION

1. Field of the Invention

The present invention relates to sink stand devices and more particularly pertains to a new sink stand device for supporting a sink and faucet in a manner having the characteristics of both a pedestal sink and a cabinet.

2. Description of the Prior Art

The use of sink stand devices is known in the prior art. U.S. Pat. No. 6,643,867 describes a support device adapted for holding a faucet assembly adjacent to a sink bowl which is raised above a counter surface. Another type of sink stand device is U.S. Pat. No. 5,253,376 which includes the ability of being illuminated. Another type of support is found in U.S. Pat. No. 1,409,255.

While these devices fulfill their respective, particular objectives and requirements, the need remains for a device that allows a sink to be mounted in such a manner that it includes the characteristics favorable to a pedestal sink while still retaining the appearance of a more traditional sink cabinet or a piece of furniture. In particular, the device should be slim in nature and allow a person the ability to position him or herself relatively near to a sink being supported by the device so that the person's torso is easily bendable over the sink.

SUMMARY OF THE INVENTION

The present invention meets the needs presented above by comprising a housing that has a bottom wall, a top wall and a peripheral wall attached to and extending between the top and bottom walls. The peripheral wall includes a front wall, a first side wall and a second side wall. A back side of the housing is open. The top wall has an opening extending therethrough. The peripheral wall is angled inward from the top wall to the bottom wall. The front wall has a door therein for selectively accessing an interior of the housing. A plurality of legs is attached to and extends downwardly from the bottom wall. A sink apparatus includes a bowl portion and a base that is attached to a bottom of the bowl portion. The base has a shape adapted for being positioned in the opening so that a bottom surface of the bowl portion abuts the top wall. The bowl portion has a drain opening therein extending through the base. A ledge is attached to an upper edge of the bowl portion and extends rearwardly therefrom. A faucet apparatus is mounted on the ledge. A water supply extends into the housing through the back side and upwardly through the ledge. The water supply is fluidly coupled to the ledge. A drainpipe extends into the housing through the back side and is fluidly coupled to the drain opening.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
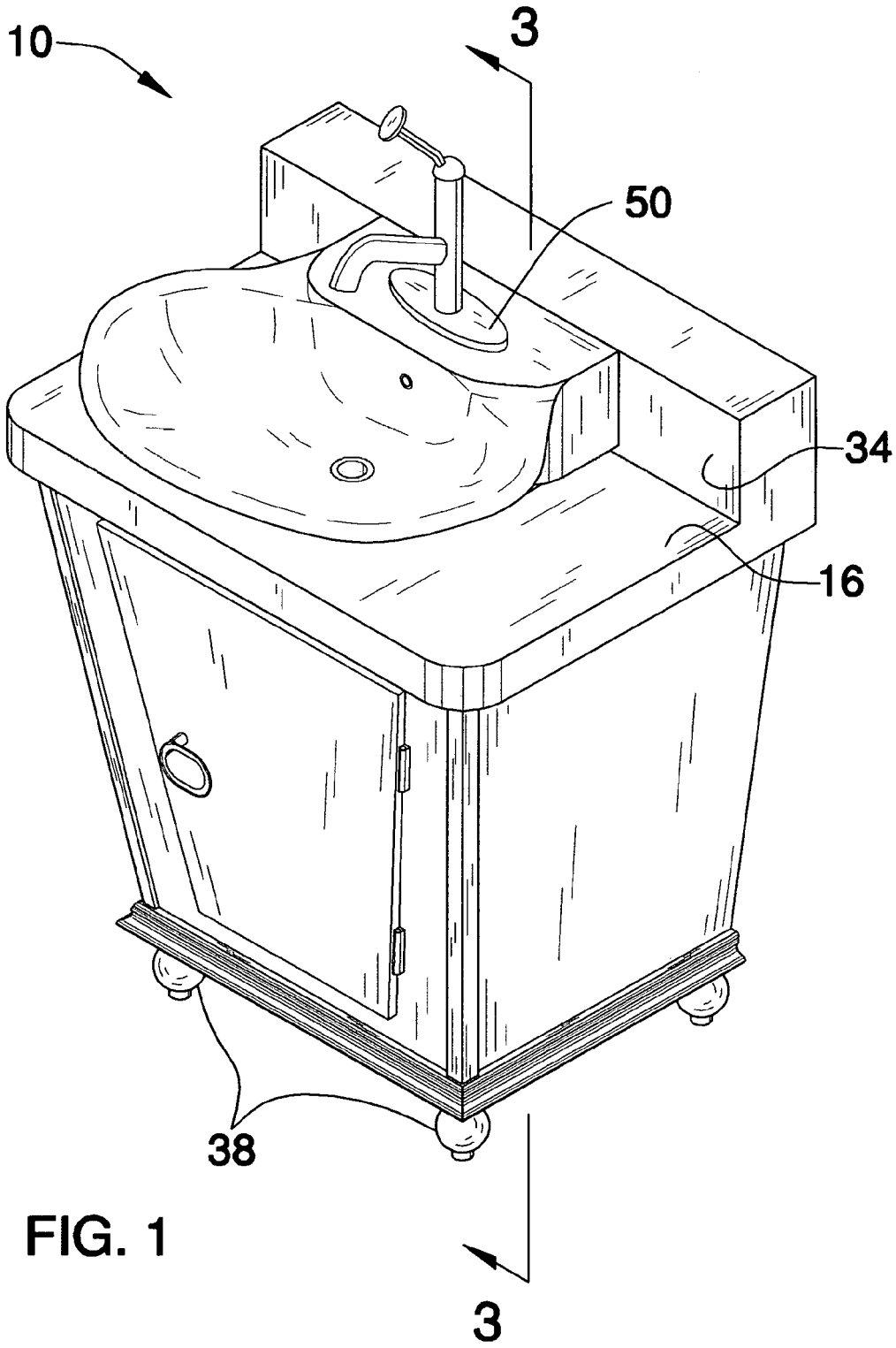
FIG. 1 is a perspective view of a sink and faucet support assembly according to the present invention.
Figure 2:
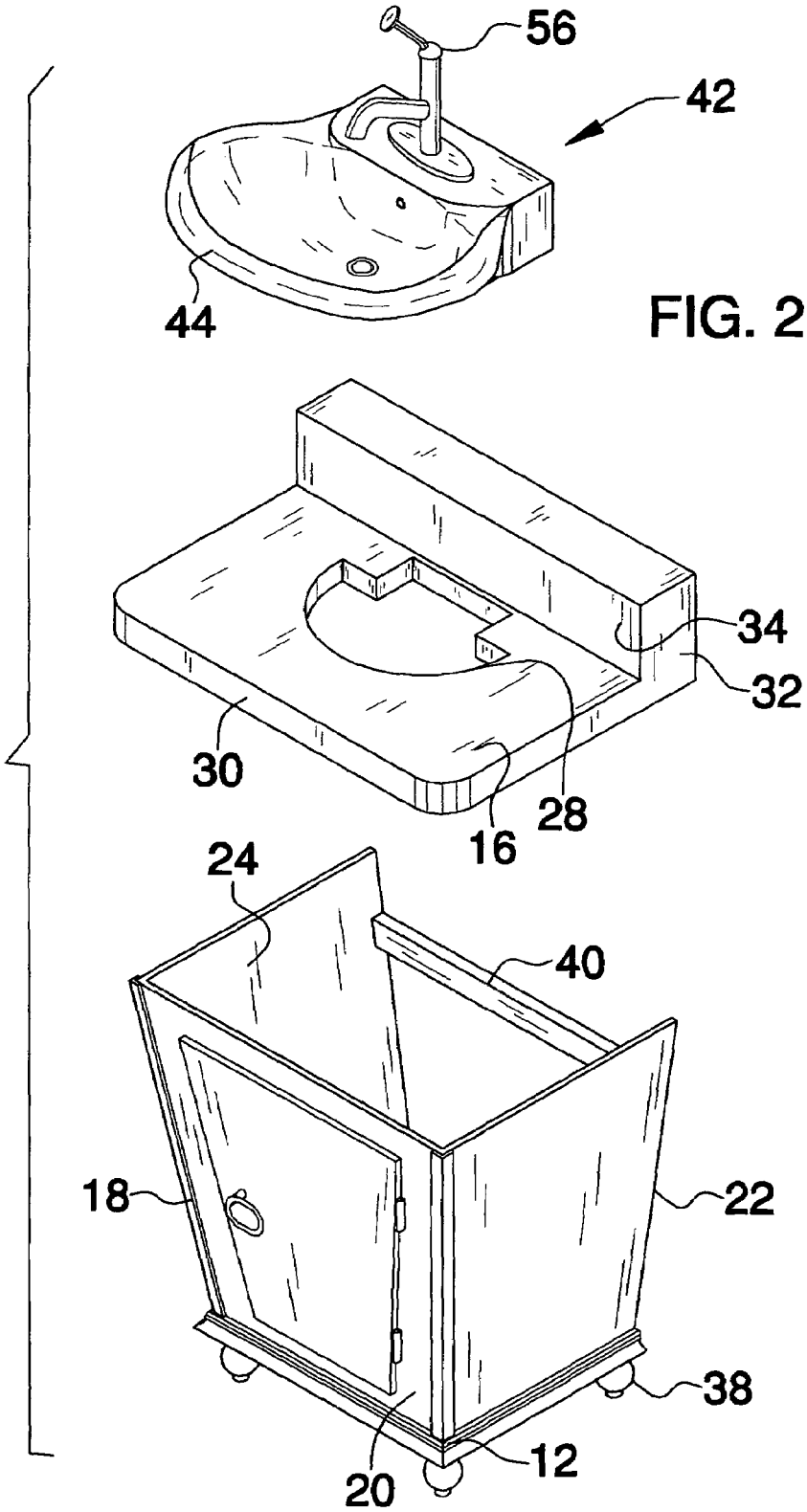
FIG. 2 is a perspective expanded view of the present invention.
Figure 3:
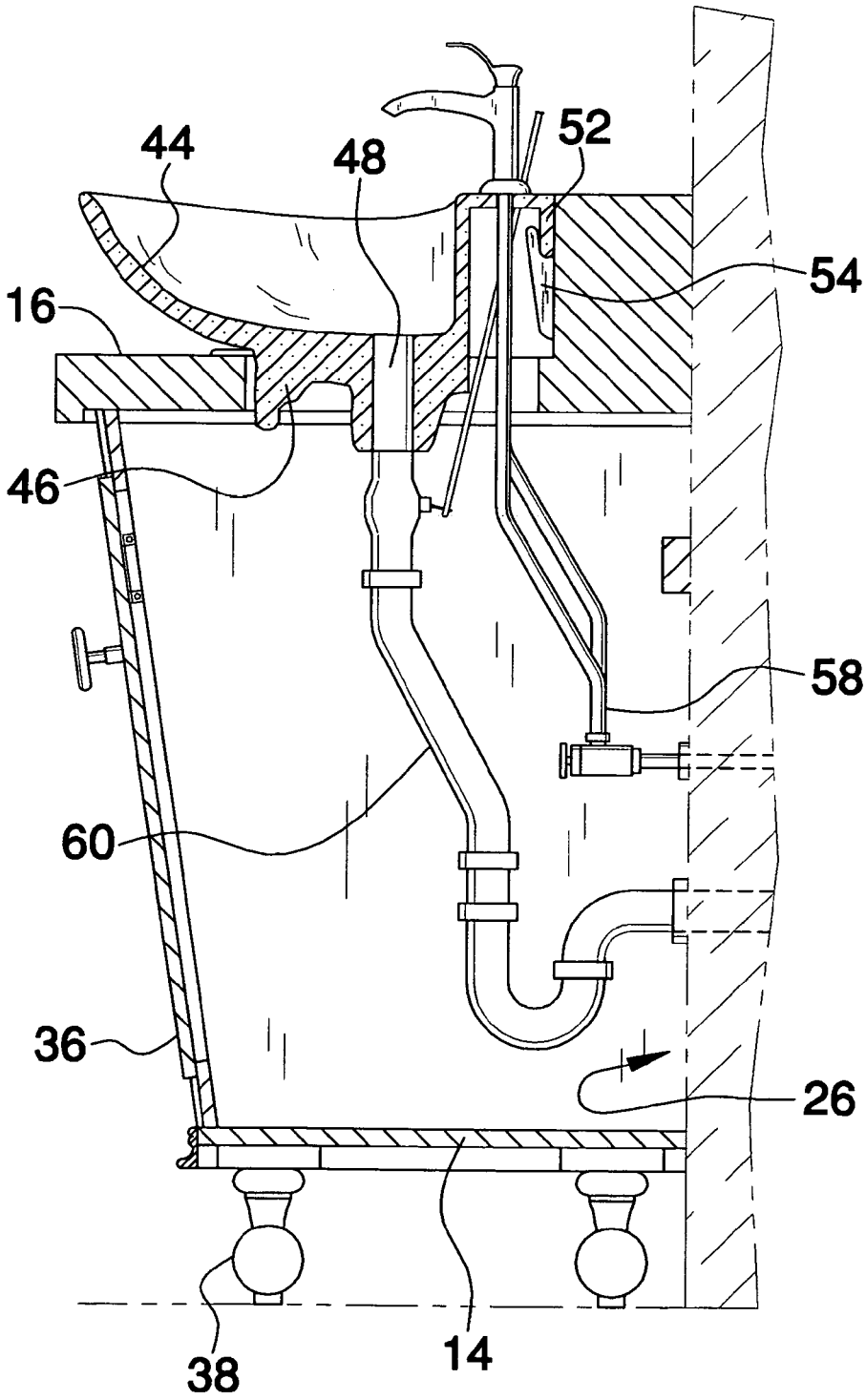
FIG. 3 is a cross-sectional view taken along line 3—3 of FIG. 1 of the present invention.

With reference now to the drawings, and in particular to FIGS. 1 through 3 thereof, a new sink stand device embodying the principles and concepts of the present invention and generally designated by the reference numeral 10 will be described.

As best illustrated in FIGS. 1 through 3, the sink and faucet support assembly 10 generally comprises a housing 12 that has a bottom wall 14, a top wall 16 and a peripheral wall 18 that is attached to and extends between the top 16 and bottom 14 walls. The peripheral wall 18 includes a front wall 20, a first side wall 22 and a second side wall 24. A back side 26 of the housing 12 is open. The top wall 16 has an opening 28 extending therethrough. The peripheral wall 18 is angled inward from the top wall 16 to the bottom wall 14 so that the housing 12 is tapered inward. This allows a person standing adjacent to the housing 12 to more easily bend their torso over the top wall 16. The top wall 16 has a peripheral edge 30 extending outwardly from the front wall 20 and the first 22 and second 24 side walls such that a lip is defined. A vertical wall 32 is integrally attached to and extends upwardly from the top wall 16. The vertical wall 32 is positioned adjacent to and extends along a rear edge of the top wall 16. The vertical wall 32 has a front surface 34 facing toward the opening 28 in the top wall 16. The front wall 20 has a door 36 therein for selectively accessing an interior of the housing 12. A plurality of legs 38 is attached to and extends downwardly from the bottom wall 14. A support 40 is attached to and extends between the first 22 and second 24 side walls. The support 40 is positioned adjacent to the back side 26 of the housing 12.

A sink apparatus 42 includes a bowl portion 44 and a base 46 that is attached to a bottom of the bowl portion 44. The base 46 has a shape adapted for being positioned in the opening 28 so that a bottom surface of the bowl portion 44 abuts the top wall 16. The bowl portion 44 has a drain opening 48 therein extending through the base 46. A ledge 50 is attached to an upper edge of the bowl portion 44 and extends rearwardly therefrom. A flange 52 is attached to and extends downwardly from the ledge 50. A stabilizer 54 is attached to the vertical wall 32 and is adapted for securing the sink apparatus 42 to the vertical wall 32. The stabilizer 54 includes a hook that attached to and extends outwardly and upwardly from the vertical wall 32. The flange 52 is positioned between a free end of the hook, or stabilizer 54, and the vertical wall 32 to aid in stabilizing the sink apparatus 42.

A faucet apparatus 56 of conventional construction is mounted on the ledge 50. A water supply 58 extends into the housing 12 through the back side 26 and upwardly through the ledge 50. The water supply 58 is fluidly coupled to the ledge 50. A drainpipe 60 extends into the housing 12 through the back side 26 and is fluidly coupled to the drain opening 48.

In use, the assembly is used as a conventional sink assembly 56. However, the assembly has the advantages of a pedestal sink while including the look of a more traditional cabinet or piece of furniture.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sink and cabinet combination assembly comprising:

a housing having a bottom wall, a top wall and a peripheral wall being attached to and extending between said top and bottom walls, said peripheral wall including a front wall, a first side wall and a second side wall, a back side of said housing being open, said top wall having an opening extending therethrough, said peripheral wall being angled inward from said top wall to said bottom wall, said front wall having a door therein for selectively accessing an interior of said housing;

a plurality of legs being attached to and extending downwardly from said bottom wall;

a sink apparatus including;

a bowl portion;

a base being attached to a bottom of said bowl portion, said base having a shape adapted for being positioned in said opening such that a bottom surface of said bowl portion abuts said top wall, said bowl portion having a drain opening therein extending through said base;

a ledge being attached to an upper edge of said bowl portion and extending rearwardly therefrom;

a faucet apparatus being mounted on said ledge;

a water supply extending into said housing through said back side and upwardly through said ledge, said water supply being fluidly coupled to said ledge; and a drainpipe extending into said housing through said back side and being fluidly coupled to said drain opening.

2. The assembly according to claim 1, wherein said top wall has a peripheral edge extending outwardly from said front wall and said first and second side walls such that a lip is defined.

3. The assembly according to claim 1, further including a vertical wall being integrally attached to and extending upwardly from said top wall, said vertical wall being positioned adjacent to and extending along a rear edge of said top wall, said vertical wall having a front surface facing toward said opening in said top wall.

4. The assembly according to claim 1, further including a support being attached to and extending between said first and second side walls, said support being positioned adjacent to said back side of said housing.

5. The assembly according to claim 1, further including a stabilizer being attached to said vertical wall and being adapted for securing said sink apparatus to said vertical wall.

6. The assembly according to claim 5, wherein a sink apparatus further includes a flange being attached to and extending downwardly from said ledge, said stabilizer including a hook being attached to and extending outwardly and upwardly from said vertical wall, said flange being positioned between a free end of said hook and said vertical wall.

7. A sink and cabinet combination assembly comprising:

a housing having a bottom wall, a top wall and a peripheral wall being attached to and extending between said top and bottom walls, said peripheral wall including a front wall, a first side wall and a second side wall, a back side of said housing being open, said top wall having an opening extending therethrough, said peripheral wall being angled inward from said top wall to said bottom wall, said top wall having a peripheral edge extending outwardly from said front wall and said first and second side walls such that a lip is defined, a vertical wall being integrally attached to and extending upwardly from said top wall, said vertical wall being positioned adjacent to and extending along a rear edge of said top wall, said vertical wall having a front surface facing toward said opening in said top wall, said front wall having a door therein for selectively accessing an interior of said housing;

a plurality of legs being attached to and extending downwardly from said bottom wall;

a support being attached to and extending between said first and second side walls, said support being positioned adjacent to said back side of said housing;

a sink apparatus including;

a bowl portion;

a base being attached to a bottom of said bowl portion, said base having a shape adapted for being positioned in said opening such that a bottom surface of said bowl portion abuts said top wall, said bowl portion having a drain opening therein extending through said base;

a ledge being attached to an upper edge of said bowl portion and extending rearwardly therefrom, a flange being attached to and extending downwardly from said ledge;

a stabilizer being attached to said vertical wall and being adapted for securing said sink apparatus to said vertical wall, said stabilizer including a hook being attached to and extending outwardly and upwardly from said vertical wall, said flange being positioned between a free end of said hook and said vertical wall;

a faucet apparatus being mounted on said ledge;

a water supply extending into said housing through said back side and upwardly through said ledge, said water supply being fluidly coupled to said ledge; and a drainpipe extending into said housing through said back side and being fluidly coupled to said drain opening.

* * * * *